United States Patent [19]

Elardi

[11] Patent Number: 4,794,732

[45] Date of Patent: Jan. 3, 1989

[54] GARAGE DOOR SECURITY SYSTEM

[76] Inventor: Salvador C. Elardi, 7001 Lemonwood La., Lemon Grove, Calif. 92045

[21] Appl. No.: 142,702

[22] Filed: Jan. 11, 1988

[51] Int. Cl.[4] ..... E05F 15/00

[52] U.S. Cl. ..... 49/280; 49/199

[58] Field of Search ..... 49/280, 197, 199, 200

[56] References Cited

U.S. PATENT DOCUMENTS

| | | | |
|---|---|---|---|
| 2,703,235 | 3/1955 | Reamey | 49/280 X |
| 3,224,493 | 12/1965 | Houk | 49/280 X |
| 4,254,582 | 3/1981 | McGee | 49/280 X |
| 4,597,224 | 7/1986 | Tucker | 49/199 |

*Primary Examiner*—Philip C. Kannan

*Attorney, Agent, or Firm*—Charles C. Logan II

[57] ABSTRACT

A garage door security system for a house having an automatic garage door opener. The system utilizes a pair of horizontally oriented locking rods that have inner ends pivotally secured to the respective top and bottom ends of an elongated secondary bar member. The secondary bar member has a pivot pin passing through its central area that is secured to the garage door itself. The horizontal locking rods pass through respective bore holes in the opposite side frame members of the garage door and when they are in their locked positions, they are inserted into bore holes in the respective side walls of the garage door opening. A primary bar which has its intermediate area pivoted about a fixed pivot pin has a roller mounted on its top end and its bottom end is pivotally secured to the top end of the secondary bar. A guide bar is attached to the top beam of the garage door opening and it is positioned to receive the roller mounted on the top end of the primary bar and direct it laterally which will cause the secondary bar to be pivoted thereby causing the horizontal locking rods to travel outwardly into the bore holes in the side walls of the garage door opening. A safety guide bar is also mounted on the top beam of the garage door opening and it functions to insure that the horizontal locking rods are in their unlocked position anytime that the garage door is being closed.

4 Claims, 1 Drawing Sheet

GARAGE DOOR SECURITY SYSTEM

BACKGROUND OF THE INVENTION

The invention relates to garage doors and more specifically to garage doors for residences having an automatic garage door opener.

In the past one of the problems that has existed with garage doors having an automatic garage door opener is the fact that the bottom ends of the garage door can be pulled outwardly a sufficient distance for a person to enter. It has been possible to put separate locking devices on the bottom of the garage door in order to secure it against an intruder, but it is necessary to manually unlock these devices anytime a person wants to use the automatic garage door opener beeper or wall switch connected thereto.

One example of existing locking rod structure for garage doors is illustrated in the Switzgable U.S. Pat. No. 3,788,678. Another example of garage door locking rod structure is seen in the Varacalli U.S. Pat. No. 3,159,205. These structures, although functional for locking the garage doors securely against intruders, are not compatible with an automatic garage door opener.

It is an object of the invention to provide a novel garage door security system that allows the bottom of the garage door to be secured automatically as the garage door is closed.

It is also an object of the invention to provide a novel garage door security system that is operational in conjunction with an automatic garage door opener in order to secure the bottom corners of the garage door against forced entry.

It is another object of the invention to provide a novel garage door security system that can be installed by the do-it-yourself handyman.

It is a further object of the invention to provide a novel garage door security system that is economical to manufacture and market.

SUMMARY OF THE INVENTION

Applicant's novel garage door security system has been designed to be utilized by residental owners' having an automatic garage door opener. Presently the bottom lateral sides of the garage door can be pulled outwardly unless a manual locking structure has been installed.

Applicant's system utilizes a pair of horizontal locking rods that have their inner ends pivotally secured to the respective top and bottom ends of a secondary bar which is vertically oriented. This secondary bar is provided about a fixed pivot pin secured to the garage door itself. The outer ends of the locking rods pass through bore holes in the side frame members of the garage door and these are aligned with bore holes in the side walls of the garage door opening. Rotational movement of the secondary bar about its fixed pivot axis causes the locking rods to travel outwardly to lock into the bore holes of the garage door opening. Reversed pivoting motion of the secondary bar causes the locking rods to be withdrawn from these bore holes. The inner end of the uppermost horizontal locking rod is pivotally attached to the bottom end of a vertically oriented primary bar. The primary bar has its intermediate area fixedly secured to pivot around a fixed pivot pin. The top end of the primary bar has a roller mounted thereon.

A guide bar is attached to the top beam of the garage door opening and it is oriented to receive the roller on the top end of the primary bar as the garage door is closed. This guide bar will direct the primary bar laterally causing a pivotal motion about its fixed pivot pin which in turn causes the secondary bar to be rotated about its pivot pin. The resulting action causes the locking rods to travel outwardly and lock into the bore holes in the side walls of the garage door opening.

A safety guide bar is also mounted on the top beam and it functions to direct the roller on the primary bar laterally into its proper path toward the guide bar. This insures that if the locking rods have been operated to their locking position prior to closing of the garage door, then the safety guide bar will direct the roller at the top of the primary bar laterally to the position where it should properly align with the guide bar.

When the garage door is to be opened, the roller attached to the top of the primary bar is directed against the back of the safety guide bar causing it to be directed laterally which results in the locking rods disengaging themselves from the apertures in the side wall of the garage door opening.

DESCRIPTION OF THE PREFERRED EMBODIMENT

Figure 4:
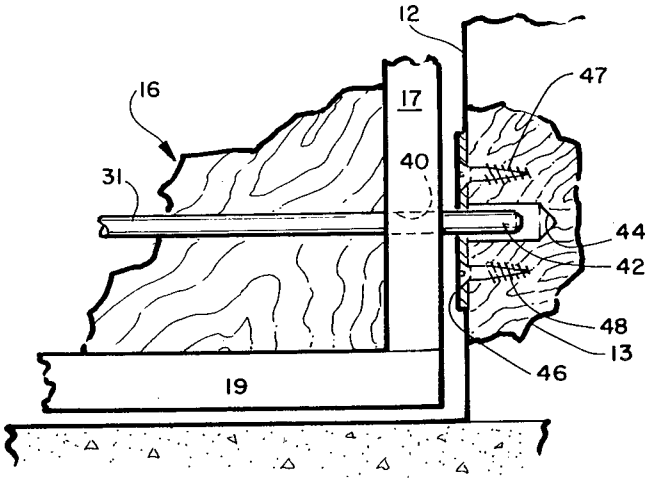
FIG. 4 is a partial elevation view of the bottom of the garage door showing how its locking rods engage the side wall of the garage door opening.

Applicant's novel garage door security system will now be described by referring to FIGS. 1–4 of the drawing. The garage door security system is generally designated numeral 10.

The garage door opening 12 is formed by laterally spaced side walls 13 and a horizontal top beam 14.

A garage door 16 is formed from laterally spaced side frame members 17, top frame member 18, and bottom frame member 19. Conventional structure is used for pivotally securing garage door 16 to the garage door opening 12. Springs 22 are part of this structure. A conventional automatic garage door opener 25 is attached to top beam 14 and garage door 16 in a well known manner.

An upper horizontal locking rod 30 and a lower horizontal locking rod 31 have their inner ends pivotally secured to first pivot assembly 33 and second pivot assembly 34 respectively. A secondary bar 36 is vertically oriented and it has its middle area secured by a fixed pivot pin 37 to a support plate 38. Secondary bar 36 has its top and bottom ends respectively secured to first pivot assembly 33 and second pivot assembly 34.

In FIG. 4, lower horizontal rod 31 is seen to pass through bore hole 40 in side frame member 17. The tip 42 of lower horizontal rod 31 in its locked position is received in bore hole 44 formed in side wall 13. A plate 46 covers bore hole 44 and is secured thereto be screws 47 and 48.

Primary bar 50 is vertically oriented and it has its bottom end pivotally connected to first pivot assembly 33. The middle portion of primary bar 50 is pivoted about fixed pivot pin 52 that is secured to support plate 54 on the rear surface of garage door 16. A roller 56 is monted on the top end of primary bar 50. Primary bar 50 may be straight or it may have a bottom portion 58, a bend 59, and a laterally offset top portion 60. Top portion 60 passes through bore hole 61 in top frame member 18. A hat-shaped bracket 62 limits the lateral travel of primary bar 50.

Figure 3:
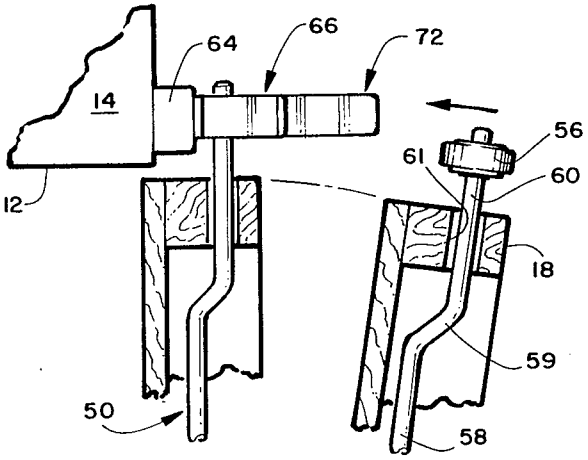
FIG. 3 is a partial side elevation view illustrating the manner in which the primary bar engages the guide bar and safety guide bar.
Figure 1:
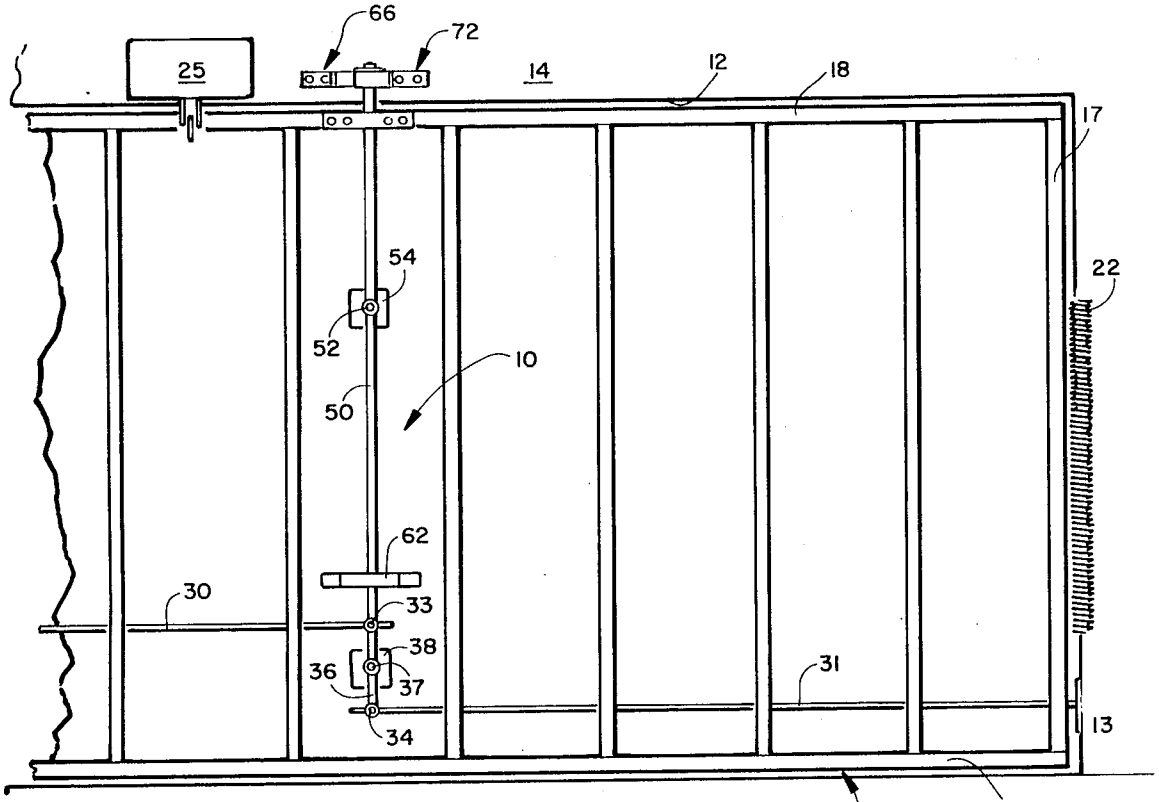
FIG. 1 is a partial rear elevation view of a garage door having applicant's novel security system installed thereon.
Figure 2:
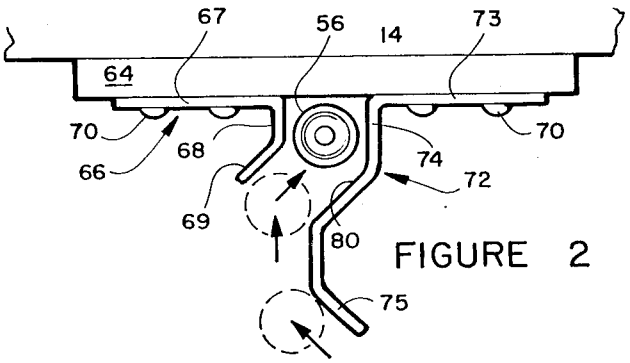
FIG. 2 is a partial top plan view illustrating the guide bar and safety guide bar attached to the top beam of the garage door opening.

Referring to FIGS. 2 and 3, the structure for directing primary bar 50 laterally will be discussed. A spacer block 64 is secured to top beam 14. A guide bar 66 having an attachment leg portion 67, a connecting member 68, and a guide leg portion 69 is secured to spacer block 64 by screws 70. Laterally spaced from guide bar 66 is a safety guide bar 72. It has an attachment leg portion 73, a connecting member 74 and realignment leg portion 75. Guide bar 66 and safety guide bar 72 form a guide channel 80 through which roller 56 travels. The lateral motion given to roller 56 results in horizontal locking rods 31 locking the bottom of the door as the roller is directed into guide channel 80. The reverse motion of roller 56 out of the guide channel causes the horizontal locking rods to disengage from the bore holes 44 in the side walls of the garage door opening. It can be noted in FIG. 2 that if roller 56 is not in its proper position for entering guide channel 80 as the door is being closed, realignment leg portion 75 of safety guide bar 72 will direct roller 56 laterally a sufficient distance so that it will properly enter guide channel 80.

What is claimed is:

1. A garage door security system comprising:

a house having a garage door opening formed with a top beam and laterally spaced side walls;

a garage door having a top frame member,a bottom frame member, laterally spaced frame members and a front wall panel;

means pivotally securing said garage door to the side walls of said garage door opening;

an automatic garage door opener secured to said garage door;

rod locking assembly means for securing the bottom lateral sides of said garage door to the side walls of said garage opening comprising: an elongated upper horizontal locking rod having an inner and an outer end, an elongated lower horizontal locking rod having an inner end and an outer end, and a normally vertically oriented secondary bar having a top end and a bottom end, a first pivot pin passing through the central area of said secondary bar and said first pivot pin being fixedly secured to said garage door adjacent its bottom end, a first pivot assembly passing through the top end of said secondary bar and the inner end of said upper horizontal locking rod, a second pivot assembly passing through the bottom end of said secondary bar and the inner end of said lower horizontal locking rod, and bore holes in the side members of said garage door adjacent its bottom end through which said respective upper and lower horizontal locking rods pass;

horizontally oriented bore holes in the respective side walls of the garage door opening adjacent their bottom ends for receiving the outer ends of the respective upper and lower horizontal locking rods when the garage door is in its locked state; and means for automatically locking and unlocking said rod locking assembly in response to said garage door being opened and closed by said automatic garage door opener comprising: a vertically oriented elongated primary bar having a top end and a bottom end, said bottom end being pivotally secured to said first pivot assembly, a roller mounted on the top end of said primary bar, a second pivot pin passing through the central area of said primary bar and said second pivot pin being fixedly secured to said garage door, and a guide bar attached to the top beam of said garage opening for engaging the roller on said primary bar thereby causing the top end of said guide bar to be directed laterally which in turn causes the rod locking assembly means to be actuated.

2. A garage door security system as recited in claim 1 further comprising a safety guide bar attached to the top beam of said garage door opening for insuring that the horizontal locking rods are in their unlocked position when the garage door is closed.

3. A garage door security system as recited in claim 1 wherein said primary bar has an offset bend portion.

4. A garage door security system as recited in claim 1 further comprising a hat-shaped bracket secured to said garage door adjacent the bottom end of said primary bar for limiting its lateral movement.

* * * * *